US006406756B1

(12) United States Patent
Popoola et al.

(10) Patent No.: US 6,406,756 B1
(45) Date of Patent: Jun. 18, 2002

(54) THERMALLY SPRAYED ARTICLES AND METHOD OF MAKING SAME

(75) Inventors: Oludele Olusegun Popoola, Novi; Ronald Paul Cooper, Eastpointe, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/339,484

(22) Filed: Jun. 24, 1999

(51) Int. Cl.[7] ..... C23C 4/06
(52) U.S. Cl. ..... 427/447; 427/455; 427/456
(58) Field of Search ..... 427/447, 455, 427/456

(56) References Cited

U.S. PATENT DOCUMENTS

| | | | | |
|---|---|---|---|---|
| 3,723,165 A | * | 3/1973 | Longo et al. | 427/447 |
| 5,496,391 A | | 3/1996 | Noel | |
| 5,518,683 A | | 5/1996 | Taylor et al. | |
| 5,651,648 A | | 7/1997 | Furey et al. | |
| 5,691,018 A | | 11/1997 | Kelley et al. | |
| 5,716,911 A | | 2/1998 | Furey et al. | |
| 5,718,863 A | | 2/1998 | McHugh et al. | |
| 5,743,961 A | | 4/1998 | Wright et al. | |
| 5,746,966 A | | 5/1998 | McDonald | |

FOREIGN PATENT DOCUMENTS

| | | | |
|---|---|---|---|
| CN | 1155016 | | 7/1997 |
| DE | 260 524 A1 | | 9/1988 |
| EP | 0 341 010 A1 | | 11/1989 |
| EP | 0 433 778 A1 | | 12/1990 |
| EP | 0 532 134 A1 | | 8/1992 |
| JP | 62050455 | | 3/1987 |
| JP | 6-88198 | * | 3/1994 |
| JP | 07003471 | | 1/1995 |

* cited by examiner

*Primary Examiner*—Katherine A. Bareford
(74) *Attorney, Agent, or Firm*—Damian Porcari

(57) ABSTRACT

A thermally sprayed article and method of making same includes the steps of providing an article to be thermally sprayed and thermally spraying a metal material against the article to form an inner layer having a first predetermined thickness. The method also includes the steps of co-depositing a polymer and the metal material against the inner layer to form an outer layer having a second predetermined thickness.

9 Claims, 2 Drawing Sheets

THERMALLY SPRAYED ARTICLES AND METHOD OF MAKING SAME

BACKGROUND OF THE INVENTION

1. Field of the Invention

The present invention relates generally to thermal spraying and, more specifically, to thermally sprayed articles and a method of making thermally sprayed articles.

2. Description of the Related Art

It is known to thermally spray articles. In thermal spraying, a thermally sprayed article is produced using a wire-arc spraying. In wire-arc spraying, electric current is carried by two electrically conductive, consumable wires with an electric arc forming between wire tips of a wire arc gun. A high-velocity gas jet blowing from behind the consumable wires strips away the molten metal, which continuously forms as the wires are melted by the electric arc. The high-velocity gas jet breaks up or atomizes the molten metal into finer particles in order to create a fine distribution of molten metal droplets. The atomizing gas then accelerates the molten metal droplets away from the wire tips to the article where the molten metal droplets impact the article to incrementally form a deposit on the article.

Thermal spraying is typically used for tribological applications and for component manufacturing. Some of the current applications include engine block bore coatings, valve seat inserts, steering stop coatings, body joint fillers and tooling. The Achilles' heel of thermally sprayed materials, particularly when considered for component manufacturing (such as in tooling and valve seat inserts for example) is their machineability. During the thermal spraying process, the molten metal droplets are formed and stacked on the article to be thermal sprayed. As a result, the machining of thermally sprayed articles generally involve a lot of interrupted bi-metallic and ceramic/metal cuts. This is detrimental to tool life and poses a problem of reproducibility of machined surfaces. Moreover, since most of the molten metal droplets generally have particle sizes ranging from 2 to 50 micrometers, the chips produced are of the same magnitude. As a result, expensive ultra-filtration operations are often required to capture the machined chips. Even then, machining-generated ultrafine particles (less than a few micrometers in size) generally remain in machining fluids and reduce the-life of coolant recirculation pumps.

Although the above process for thermally spraying articles has worked well, it is desirable to improve the machinability of thermally sprayed articles. It is also desirable to produce a thermally sprayed article that has larger chips when machined. It is further desirable to produce a thermally sprayed article that has reduced cost.

SUMMARY OF THE INVENTION

Accordingly, the present invention is a thermally sprayed article. The thermally sprayed article has an inner layer of a metal material with a first predetermined thickness. The thermally sprayed article also has an outer layer formed on the inner layer of a composite made of a polymer and the metal material with a second predetermined thickness.

Also, the present invention is a method of making a thermally sprayed article. The method includes the steps of providing an article to be thermally sprayed. The method also includes the steps of thermally spraying a metal material against the article to form an inner layer having a first predetermined thickness and co-depositing a polymer and the metal material against the inner layer to form an outer layer having a second predetermined thickness.

One advantage of the present invention is that a highly machinable thermally sprayed article and method of making the article is provided. Another advantage of the present invention is that the method improves the machinability of thermally sprayed articles by modifying the outer layer to be machined. Yet another advantage of the present invention is that the method decreases the hardness and increases the plasticity and lubricity of the outer layer while the hardness of the inner layer remains unchanged. Still another advantage of the present invention is that the method provides a way to connect splats and avoid interrupted cuts of the thermally sprayed article. A further advantage of the present invention is that the method produces thermally sprayed articles that, when machined, have long and curled machined chips that are easy to recover.

Other features and advantages of the present invention will be readily appreciated, as the same becomes better understood after reading the subsequent description taken in conjunction with the accompanying drawings.

DESCRIPTION OF THE PREFERRED EMBODIMENT(S)

Figure 1:
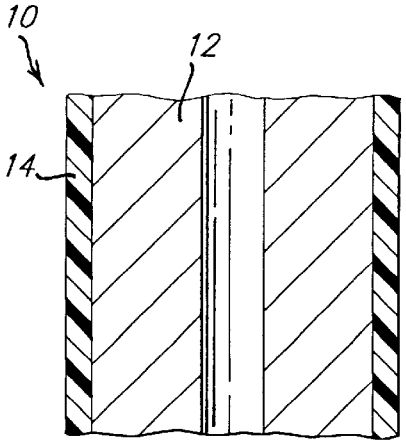
FIG. 1 is a fragmentary elevational view of a thermally sprayed article, according to the present invention.

Referring to the drawings and in particular FIG. 1, one embodiment of a thermally sprayed article 10, according to the present invention, is shown. The thermally sprayed article 10, in this embodiment, is a cylindrical hollow rod to be used for a valve seat application. It should be appreciated that the thermally sprayed article 10 may be used in various applications such as engine block bore coatings, valve seat inserts, steering stop coatings, body joint fillers and tooling.

The thermally sprayed article 10 has an inner layer 12 of a bulk material with a predetermined thickness. The bulk material is a metal material. Metal materials usable for thermal spraying include metals such as aluminum and high temperature high strength carbon steel. These include certain tool steels such as A2 and plain carbon steel with (0.8% carbon by weight) as well as maraging steels. Maraging steels are difficult to machine and are seldom used for tooling, but can be readily spray formed to produce a desirable microstructure.

The thermally sprayed article 10 also has an outer layer 14 formed on top of the inner layer 12 with a predetermined thickness. The outer layer 14 is a composite made of the metal material used for the inner layer 12 and a polymer such as a thermoplastic polymer, for example, polyethylene or a thermoset polymer. The predetermined thickness of the outer layer 14 is less than the predetermined thickness of the inner layer 12. The outer layer 14 has a hardness less than a hardness of the inner layer 12. For example, the outer layer 14 may have a surface hardness of 20 Rockwell C while the inner layer 12 may have a surface hardness of 50 to 60 Rockwell C.

Figure 2:
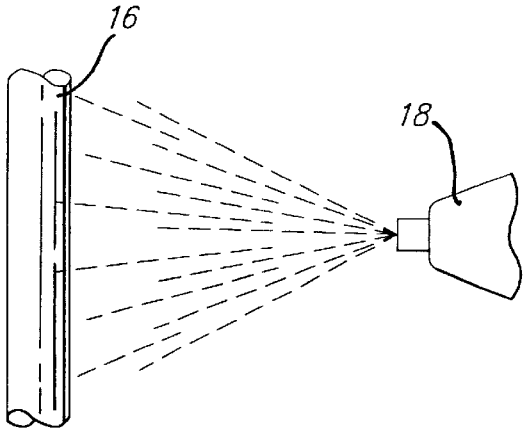
FIG. 2 is an elevational view of a first step of a method, according to the present invention, of making the thermally sprayed article of FIG. 1.
Figure 3:
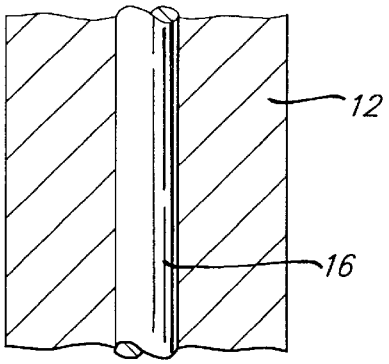
FIG. 3 is a view similar to FIG. 2 illustrating a second step of the method.

Referring to FIGS. 2 through 5, the thermally sprayed article 10 is made by a method, according to the present invention. The method includes providing an article 16 and thermally spraying a metal material against the article 16 as illustrated in FIG. 2. Such step is desirably carried out by the wire arc process using a wire arc gun 20 previously described. Another method to carry out the step of thermally spraying is the osprey process wherein a semi-solid slurry of hardenable metal material is sprayed from an induction heated nozzle supply and is impelled against the article 16 with a high velocity due to the high pressure gases that atomize the molten fluid. Metal droplets are formed from a melt that is atomized by gas (not from wire or powder). Continuous spraying is carried out to build up a layer that exceeds at least one-quarter (¼) inch in thickness, at its thinnest section. The method includes the step of forming the inner layer 12 to a first predetermined thickness as the thermal sprayed metal material is applied and built up on the article 16 as illustrated in FIG. 3. It should be appreciated that thermal spraying is conventional and known in the art.

Figure 5:
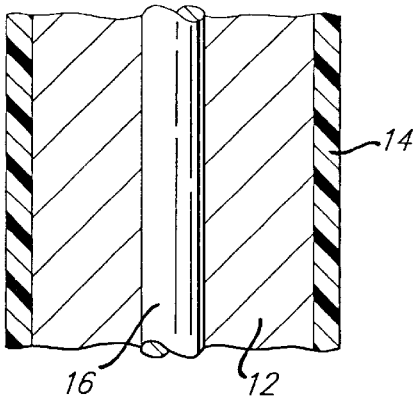
FIG. 5 is a view similar to FIG. 2 illustrating a fourth step of the method.
Figure 4:
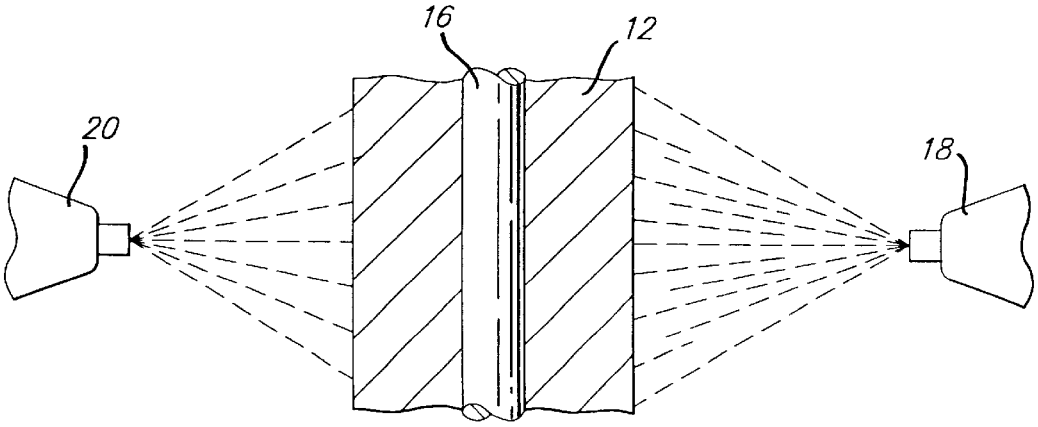
FIG. 4 is a view similar to FIG. 2 illustrating a third step of the method.

Once the inner layer 12 is formed, the method includes the step of co-depositing a polymer and the metal material against the inner layer 12 as illustrated in FIG. 4. During the final stages of thermal spraying, such step is desirably carried out using a flame spray gun 20 and a polymer, preferably a low cost stable thermoplastic polymer. The method includes the step of forming the outer layer 14 to a second predetermined thickness as the metal material from the thermal spray gun 18 and the polymer from the flame spray gun 20 are applied and built up on the inner layer 12 as illustrated in FIG. 5. It should be appreciated that flame spraying is conventional and known in the art.

Figure 6A:
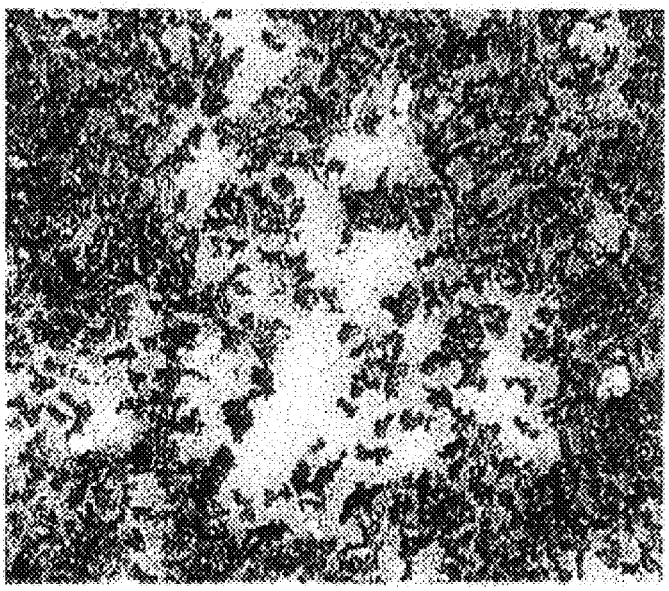
FIGS. 6A and 6B are diagrammatic views of chips produced during machining of conventionally thermally sprayed articles and thermally sprayed articles of FIG. 1, respectively.
Figure 6B:
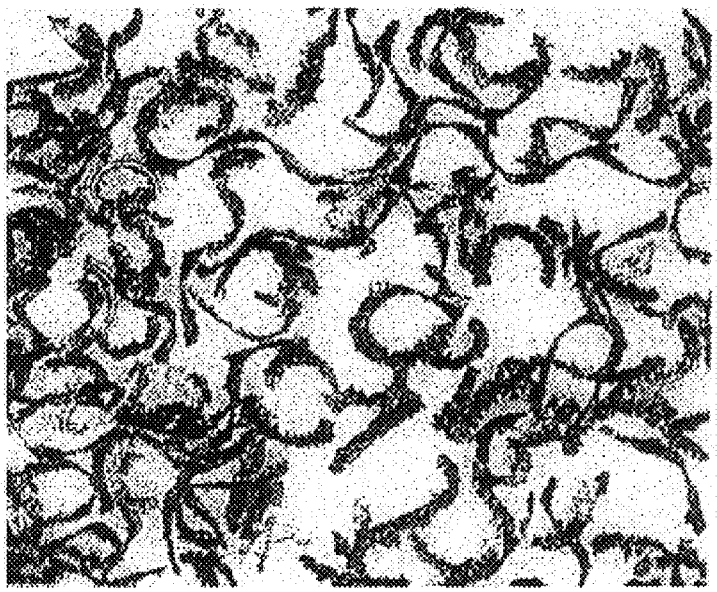

The completed thermally sprayed article 10 will have the required bulk structure or inner layer 12 and properties with a soft and continuous outer layer 14 that can be easily machined. FIG. 6A shows the types of chips produced during lathe machining for conventional thermally sprayed articles and FIG. 6B shows the types of chips produces during lathe machining for the thermally sprayed articles 10. The machined chips of FIG. 6B are long and curled as compared to the machined chips of FIG. 6A. The machined chips of FIG. 6B are produced with conventional carbide machining tools whereas the machined chips of FIG. 6A are produced with conventional diamond machining tools. The machined chips of FIG. 6B have a size of approximately one (1) to three (3) millimeters whereas the machined chips of FIG. 6A have a size of approximately fifty (50) to one-hundred (100) micrometers. It should be appreciated that ultrafiltration is not required for the machined chips of FIG. 6B of the completed thermally sprayed article 10.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of making a thermally sprayed article comprising the steps of:

providing an article to be thermally sprayed;

providing a separate metal material to thermally spray;

providing a separate polymer material to spray;

thermally spraying the metal material against the article to form an inner layer having a first predetermined thickness; and co-depending by separately flame spraying the polymer material and spraying the metal material against the inner layer to form an outer having a second predetermined thickness.

2. A method as set forth in claim 1 wherein said step of co-depositing comprises thermally spraying the metal material.

3. A method as set forth in claim 1 including the step of machining the outer layer and producing chips having a size of approximately one to three millimeters.

4. A method of making a thermally sprayed article comprising the steps of:

providing an article to be thermally sprayed;

providing a separate metal material to thermally spray;

providing a separate polymer material to spray;

thermally spraying the metal material against the article to form an inner layer having a first predetermined thickness;

co-depositing by separately flame spraying the polymer material and spraying the metal material against the inner layer to form an outer layer having a second predetermined thickness; and forming the second predetermined thickness less than the first predetermined thickness.

5. A method of making a thermally sprayed article comprising the steps of:

providing an article to be thermally sprayed;

providing a separate metal material to thermally spray;

providing a separate polymer material to spray;

thermally spraying the metal material against the article to form an inner layer having a first predetermined thickness;

co-depositing by separately flame spraying the polymer material and spraying the metal material against the inner layer to form an outer layer having a second predetermined thickness; and forming the outer layer with a hardness less than a hardness of the inner layer.

6. A method of thermally spraying an article comprising the steps of:

providing an article to be sprayed;

providing a separate metal material to thermally spray;

providing a separate polymer material to flame spray;

thermally spraying the metal material against the article form an inner layer; and concurrently flame spraying the polymer material and thermally spraying the metal material, using separate spray guns, against the inner layer to form an outer layer.

7. A method as set forth in claim 6 including the step of machining the outer layer and producing chips having a size of approximately one to three millimeters.

8. A method of thermally spraying an article comprising the steps of:

providing an article to be sprayed;

providing a separate metal material to thermally spray;

providing a separate polymer material to flame spray;

thermally spraying the metal material against the article to form an inner layer;

concurrently flame spraying the polymer material and thermally spraying the metal material, using separate spray guns, against the inner layer to form an outer layer; and forming the outer layer with a thickness less than that of the inner layer.

9. A method of thermally spraying an article comprising the steps of:

providing an article to be sprayed;

providing a separate metal material to thermally spray;

providing a separate polymer material to flame spray;

thermally spraying the metal material against the article to form an inner layer;

concurrently flame spraying the polymer material and thermally spraying the metal material, using separate spray guns, against the inner layer to form an outer layer; and forming the outer layer with a hardness less than the inner layer.

* * * * *